US007350498B2

(12) United States Patent
Matsuda

(10) Patent No.: US 7,350,498 B2
(45) Date of Patent: Apr. 1, 2008

(54) CRANKSHAFT OF ENGINE

(75) Inventor: Yoshimoto Matsuda, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 5 days.

(21) Appl. No.: 11/388,240

(22) Filed: Mar. 22, 2006

(65) Prior Publication Data

US 2006/0225689 A1 Oct. 12, 2006

(30) Foreign Application Priority Data

Mar. 23, 2005 (JP) ..... 2005-083004

(51) Int. Cl.
*F01M 1/06* (2006.01)

(52) U.S. Cl. ..... 123/196 R

(58) Field of Classification Search ..... 123/196 R; 74/605; 184/6.5

See application file for complete search history.

(56) References Cited

U.S. PATENT DOCUMENTS 5,138,991 A * 8/1992 Wojdyla ..... 123/196 R 6,857,411 B2 * 2/2005 Ronneburger et al. .. 123/196 R

FOREIGN PATENT DOCUMENTS

JP SHO61-58730 4/1986

* cited by examiner

*Primary Examiner*—Stephen K. Cronin
*Assistant Examiner*—Hyder Ali
(74) *Attorney, Agent, or Firm*—Alleman Hall McCoy Russell & Tuttle LLP

(57) ABSTRACT

A crankshaft equipped in an engine, including an oil passage through which oil is drawn from a crank journal to a crank pin. The oil passage has an inlet formed at a peripheral region of the crank journal. When a plane including a center axis of the crank journal and a center axis of the crank pin crosses a peripheral surface of the crank journal at two cross portions, the inlet is located to be spaced apart in an opposite direction to a rotational direction of the crank journal from a journal side cross portion located on an opposite side of the crank pin with respect to the center axis of the crank journal. The oil passage is configured to extend to be spaced apart from the center axis of the crank journal as seen from a direction of the center axis of the crankshaft.

3 Claims, 8 Drawing Sheets

CRANKSHAFT OF ENGINE

TECHNICAL FIELD

The present invention relates to a crankshaft that is equipped in an interior of an engine and is provided with an oil passage.

BACKGROUND ART

In four-cycle engines, oil is fed to engine components located therein to lubricate and cool them. These engines are provided with oil passages and the oil is pumped by an oil pump configured to rotate in cooperation with a crankshaft to flow to the engine components through the oil passages. The crankshaft is accommodated in a crankcase. The oil is fed to a region at which a crank journal and a journal bearing are configured to slidably contact each other or to a region at which a crank pin and a big end of a connecting rod are configured to slidably contact each other, in order to lubricate and cool them.

Japanese Utility Model Application Publication No. Sho. 61-58730 discloses a configuration to feed oil to the above regions of the crankshaft. According to this configuration, an oblique oil passage is formed to extend obliquely with respect to a rotational axis of the crankshaft and to couple a center axis of a crank journal to a center axis of a crank pin (see FIG. 2). To be specific, the oblique oil passage extends from the crank journal to the crank pin through a crank web and further penetrates through another crank web and is configured to open at the latter crank web. A blank plug is attached to this opening (see FIG. 1).

Further, the crank journal is provided with a first oil passage configured to extend radially and to penetrate through the crank journal. The first oil passage is connected to the oblique oil passage. The crank pin is provided with a second oil passage configured to extend radially and to penetrate through the crank pin. The second passage is also connected to the oblique oil passage.

In engines equipped with the above constructed crankshaft, the oil is fed to a groove formed in the journal bearing for the crank journal. Some oil is fed to a region at which the journal bearing and the crank journal are configured to slidably contact each other, and the remaining oil flows into the interior of the crank journal through the first oil passage and further toward the crank pin through the oblique oil passage. Further, the oil is delivered to an outer peripheral surface of the crank pin through the second oil passage in the interior of the crank pin and is fed to a region at which the crank pin and the big end of the connecting rod are configured to slidably contact each other.

The oil is pumped by the oil pump configured to rotate in cooperation with the crankshaft to be fed to the engine components. The pressure of the oil is generally determined by a capacity of the oil pump and an engine speed of the engine. Regarding the oil fed to the crank pin through the oil passage in the interior of the crankshaft, a desired pressure of the oil increases in proportion to the square of the engine speed, i.e., the number of rotations of the crankshaft.

In the case of the crankshaft provided with the oblique oil passage, and the first and second oil passages, the oil flows through the first oil passage and then is delivered to flow radially inward from an outer peripheral region of the crank journal to the center axis of the crank journal where the first oil passage is connected to the oblique oil passage. Therefore, during rotation of the crankshaft, the oil flowing in the first oil passage is subjected to a centrifugal force applied in an opposite direction to a flow direction of the oil. This centrifugal force increases with an increase in the number of rotations of the crankshaft and impedes the flow of the oil.

In order to suitably feed the oil to the engine components during high-speed rotation in the engine disclosed in the above Japanese Utility Model Application Publication No. Sho. 61-58730, it may be necessary to equip a larger oil pump to ensure a higher pressure of the oil. The larger oil pump causes a larger friction loss of the associated components.

Furthermore, in the configuration disclosed in the above Japanese Utility Model Application Publication No. Sho. 61-58730, the oblique oil passage, and the first and second oil passages extend in different directions. During drilling bores in the crankshaft to form these passages, it is necessary to change orientation of a drill machine or change orientation of the crankshaft and to re-fix the crankshaft, resulting in a burdensome manufacturing process.

SUMMARY OF THE INVENTION

The present invention addresses the above described conditions, and an object of the present invention is to provide a crankshaft that is provided with an oil passage that enables oil to easily flow therethrough, without a need for a large oil pump. Another object of the present invention is to provide a crankshaft in which the oil passage is easily formed.

According to the present invention, there is provided a crankshaft equipped in an engine, comprising an oil passage through which oil is drawn from a crank journal of the crankshaft to a crank pin of the crankshaft; wherein the oil passage has an inlet formed at a peripheral region of the crank journal, and when a plane including a center axis of the crank journal and a center axis of the crank pin crosses a peripheral surface of the crank journal at two cross portions, the inlet is located to be spaced apart in an opposite direction to a rotational direction of the crank journal from a journal side cross portion which is one of the two cross portions, the journal side cross portion being located on an opposite side of the crank pin with respect to the center axis of the crank journal; and wherein the oil passage is configured to extend to be spaced apart from the center axis of the crank journal as seen from a direction of the center axis of the crank journal.

With such a construction, the oil flows in the oil passage so as not to move toward the center axis of the crank journal. Therefore, a centrifugal force applied to the oil during rotation of the crankshaft can be reduced. As a result, the oil easily flows in the oil passage in the interior of the crankshaft.

The oil passage may have an outlet formed at a peripheral region of the crank pin, and when the plane crosses a peripheral surface of the crank pin at two cross portions, the outlet may be located at a pin side cross portion which is one of the two cross portions, the pin side cross portion being located on an opposite side of the crank journal with respect to the center axis of the crank pin. With such a construction, the oil is suitably fed to a region at which the crank pin and the connecting rod are configured to slidably contact each other. The reason for this is as follows. When an explosion takes place in a combustion chamber of the engine, a large load (greatest explosion load) is applied to a specified region in the peripheral region of the crank pin. The specified region, i.e., a region to which the greatest explosion load is applied, is located in the vicinity of the pin side cross portion to be spaced apart in the opposite direction to the rotational direction of the crank pin. Since the outlet of the oil passage is formed at the pin side cross portion of the crank pin as described above, the oil can be suitably fed to the region in the peripheral region of the crank pin, to which the greatest explosion load is applied. As a result, this region is suitably lubricated and cooled, during rotation of the engine.

The inlet of the oil passage may be configured to have an opening direction inclined in the rotational direction of the crank journal, with respect to a radial direction of the crank journal from the center axis of the crank journal toward the inlet. With such a construction, during rotation of the crankshaft, the oil existing between the crank journal and a journal bearing is suctioned up into the inlet to be drawn through the oil passage. As a result, the oil easily flows into the oil passage.

The oil passage may be configured to extend in a straight line shape from the inlet to the outlet. This facilitates drilling of the passage. In addition, since there are no openings other than openings forming the inlet and the outlet of the oil passage, blank plugs for closing these openings may be omitted.

The oil passage may be a first of at least two oil passages configured to extend substantially in parallel with each other. The crank pin may be a first of two crank pins that are located adjacent and on both sides of the crank journal. One of the oil passages may be located between the crank journal and one of the two crank pins. The other one of the oil passages may be located between the crank journal and the other crank pin. Since the plurality of oil passages extend substantially in parallel with each other, the drilling work to form the oil passage is easily carried out.

The above and further objects and features of the invention will more fully be apparent from the following detailed description with accompanying drawings.

DETAILED DESCRIPTION OF THE PREFERRED EMBODIMENTS

Figure 1:
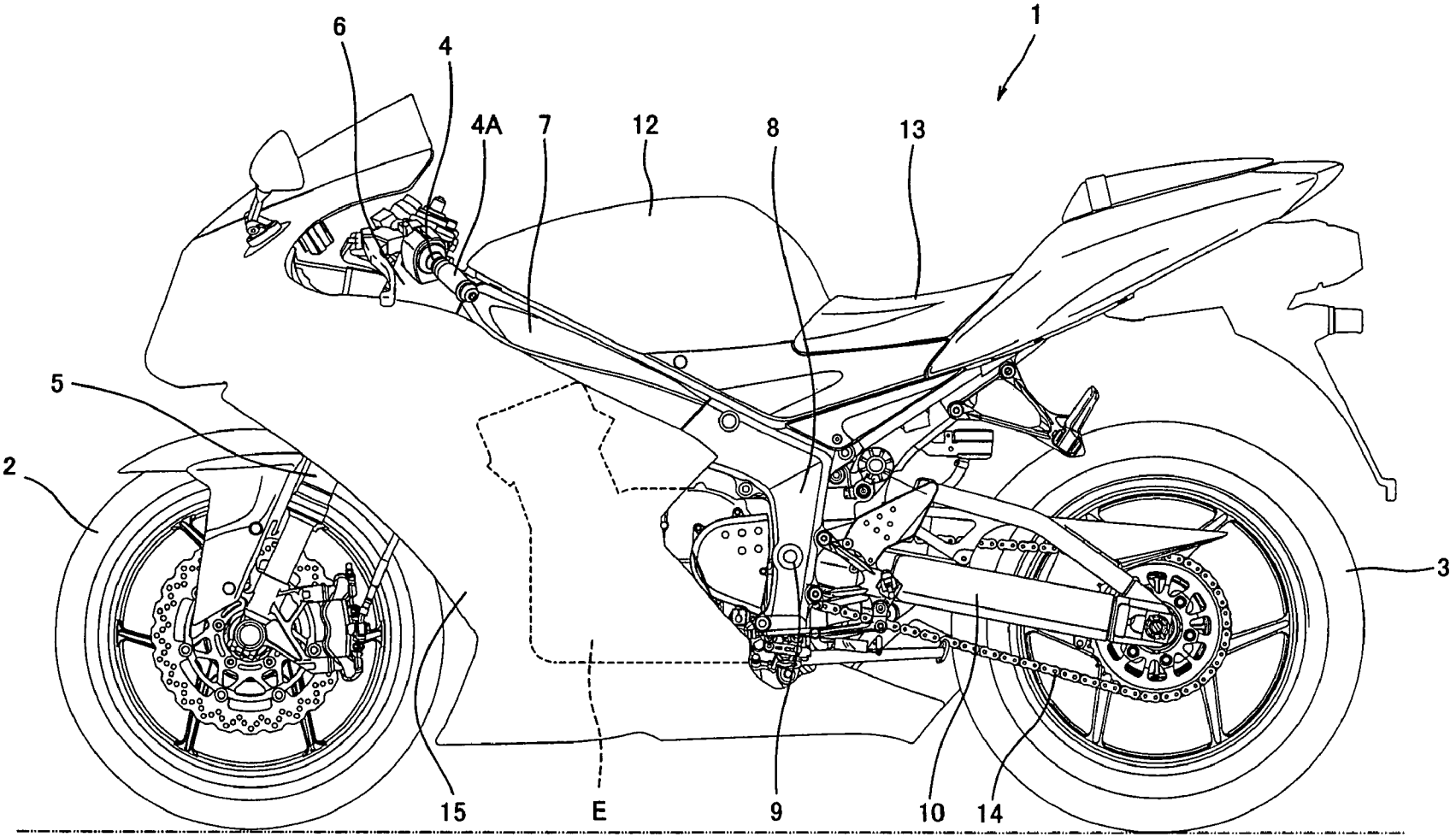
FIG. 1 is left side view of a motorcycle equipped with an engine including a crankshaft according to an embodiment of the present invention.

Hereinafter, an embodiment of a crankshaft of an engine of the present invention will be described below. FIG. 1 is a left side view of a motorcycle 1 of a road sport type. As used herein, the term "directions" refers to directions from the perspective of a rider seated on the motorcycle 1 of FIG. 1.

Turning now to FIG. 1, the motorcycle 1 includes a front wheel 2 and a rear wheel 3. The front wheel 2 is rotatably mounted to a lower region of a front fork 5 extending substantially vertically. A bar-type steering handle 4 is attached to an upper region of the front fork 5. The front fork 5 is mounted to a steering shaft (not shown) extending in parallel with the front fork 5. The steering shaft is rotatably supported by a head pipe 6 of a vehicle body. When the rider rotates the steering handle 4 clockwise or counterclockwise, the front wheel 2 is turned to a desired direction.

A pair of right and left main frames 7 (only left main frame 7 is illustrated in FIG. 1), forming a frame of the vehicle body, extend rearward from the head pipe 6. Pivot frames (swing arm brackets) 8 extend downward from rear regions of the main frames 7. A swing arm 10 is pivotally mounted at a front end portion thereof to a pivot 9 attached on the left pivot frame 8. The rear wheel 3 is rotatably mounted to a rear end portion of the swing arm 10.

A fuel tank 12 is disposed above the main frames 7 and behind the steering handle 4. A straddle-type seat 13 is disposed behind the fuel tank 12. An engine E is mounted between and under the right and left main frames 7. The engine E is an inline four-cylinder four-cycle engine, and is constructed in such a manner that a crankshaft 50 extends in a width direction of the vehicle body. An output of the engine E is transmitted, through a chain 14, to the rear wheel 3, which thereby rotates. Thus, the motorcycle 1 obtains a driving force.

A cowling 15 is mounted to cover a front region of the motorcycle 1, i.e., an upper region of the front fork 5 and side regions of the engine E. Mounting the seat 13, the rider grips a grip 4A attached at an end portion of the steering handle 4, and the rider's feet rest on foot rests provided in the vicinity of a rear region of the engine E. Under this condition, the rider is ready to start-up the motorcycle 1.

Figure 2:
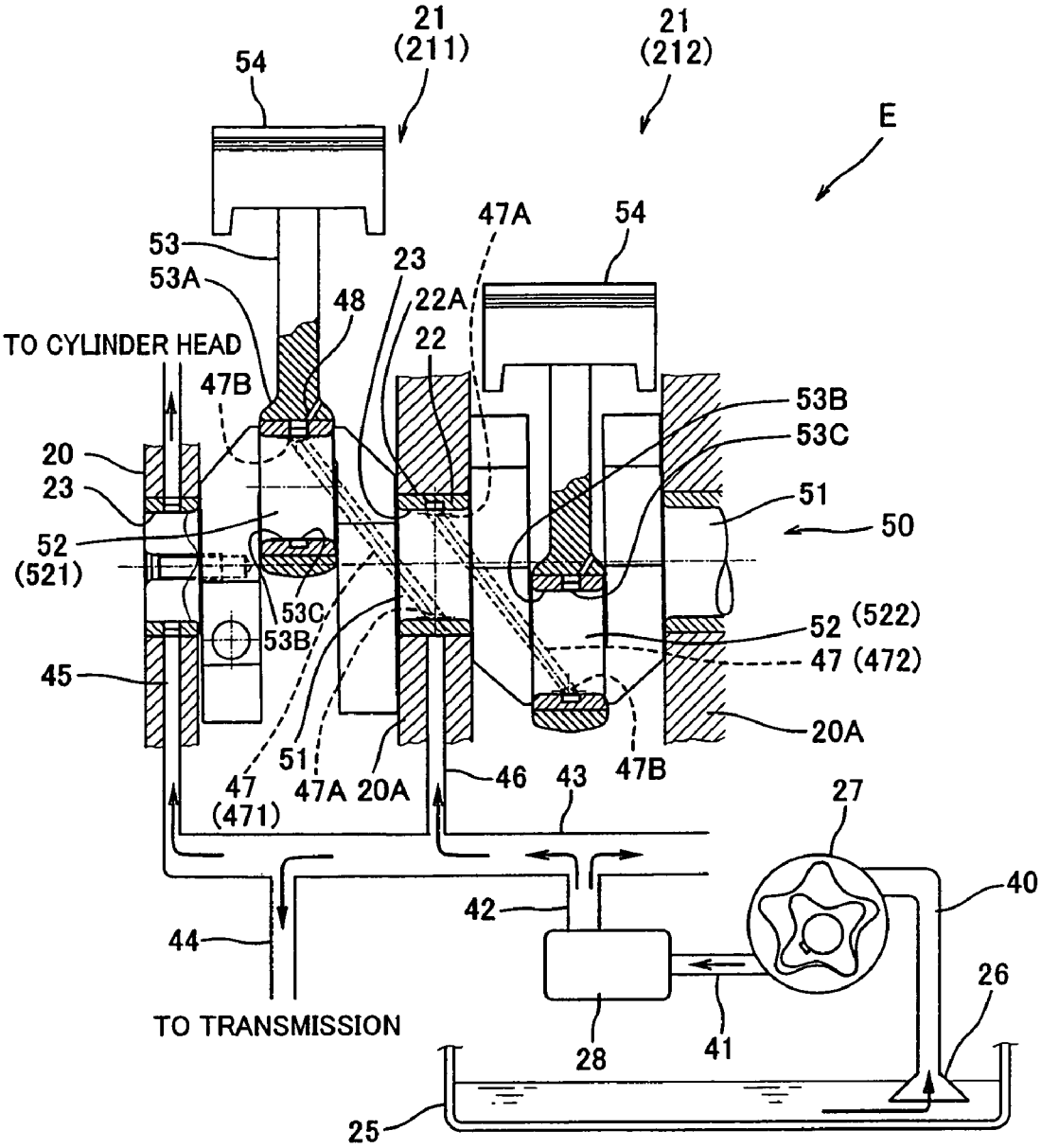
FIG. 2 is a view schematically showing an oil feed system equipped in the engine of FIG. 1.

FIG. 2 is a view schematically showing an oil feed system equipped in the engine E of FIG. 1. As shown in FIG. 2, the engine E is provided with bulkheads 20A that are formed integrally with a crankcase 20 and are configured to define cylinders 21. The respective bulkheads 20A are provided with penetrating bores extending in the width direction (rightward and leftward direction) with their centers conforming to each other. A tubular metal structure 22 is provided in each penetrating bore to form a journal bearing 23. The crankshaft 50 of the engine E has crank journals 51 rotatably supported by the journal bearings 23. FIG. 2 illustrates a portion of the crankshaft 50 corresponding to two cylinders 21, respectively indicated at a first cylinder 211 and a second cylinder 212, which are arranged in this order from the left end.

The engine E includes an oil pan 25 that is located under the crankcase 20 and is configured to store lubricating oil. A strainer 26 is provided in the vicinity of an inner bottom region of the oil pan 25. An oil passage 40 extends from the strainer 26 to an inlet of an oil pump 27. The oil is suctioned from the interior of the oil pan 25 into the oil pump 27 through the strainer 26 and the oil passage 40.

A passage 41 extends from an outlet of the oil pump 27 to an inlet of an oil filter 28. The oil filter 28 serves to remove unwanted substances from the oil pumped by the oil pump 27. An outlet of the oil filter 28 is connected to a main oil gallery 43 through an oil passage 42. The main oil gallery 43 forms a main part of the oil feed system equipped in the engine E, and is configured to extend in the width direction through an interior of a wall of the crankcase 20. From the main oil gallery 43, the oil is delivered to the engine components in the interior of the engine E.

An oil passage 44 branches from a position of the main gallery 43. Some oil is delivered to a transmission (not shown) through the oil passage 44 to lubricate mounting regions of a main shaft and a counter shaft (not shown) of the transmission or meshed regions of gears of the transmission. Furthermore, right and left oil passages 45 (one of the oil passages 45 is illustrated in FIG. 2) extend from right and left end regions of the main gallery 43 and through an interior of an outer wall of the crankcase 20. Each of the oil passages 45 extends upward along the outer wall of the crankcase 20 to a cylinder head (not shown) disposed above the crankcase 20 through the journal bearing 23 of the crankshaft 50. Some oil is delivered from the main gallery 43 to a camshaft or the like (not shown) mounted in an upper region of the cylinder head through the oil passages 45 to lubricate them.

Furthermore, passages 46 extend from a position of the main oil gallery 43, through interiors of the bulkheads 20A, and to the journal bearings 23. The metal structure 22 forming the journal bearing 23 has a groove 22A formed on an inner peripheral wall thereof to extend in a circumferential direction thereof. The groove 22A has a penetrating hole extending through the metal structure 22 to allow an inside and an outside of the metal structure 22 to communicate with each other. This penetrating hole is connected to the oil passage 46. The oil is delivered from the main oil gallery 43 through the oil passage 46 and is fed to the groove 22A of the metal structure 22 and a region around the groove 22A through the penetrating hole. The oil leaking out from the groove 22A of the metal structure 22 lubricates the region at which the crank journal 51 and the journal bearing 23 are configured to slidably contact each other.

As described later, the crankshaft 50 is provided with oil passages 47, including first and second oil passages 471 and 472, which extend obliquely from the crank journals 51 to the crank pins 52, including first and second crank pins 521 and 522. As shown in FIG. 2, the oil passage 471 extends from the crank journal 51 supported on the journal bearing 23 mounted in the bulkhead 20A that defines the first and second cylinders 211 and 212 to crank pin 521 located in the interior of the first cylinder 211, and the oil passage 472 extends from the crank journal 51 to the crank pin 522 located in the interior of the second cylinder 212. In the depicted embodiment, the first and second cylinders 211 and 212 are symmetric to the third and fourth cylinders in the width direction.

Each oil passage 47 (including oil passages 471 and 472) has an inlet 47A that opens in a peripheral region of the crank journal 51 and communicates with the groove 22A formed on the metal structure 22 of the journal bearing 23 through the inlet 47A. A piston 54 is coupled to an upper region of a connecting rod 53. A big end 53A of the connecting rod 53 is rotatably coupled to the crank pin 52. The oil passage 47 has an outlet 47B that opens at a peripheral region of the crank pin 52. The oil passage 47 communicates, through the outlet 47B, with a groove 53C of a crank pin bearing 53B mounted on the big end 53A of the connecting rod 53. The big end 53A is provided with an oil passage 48 extending to penetrate therethrough to allow an inner peripheral region of the big end 53A to communicate with the outside.

The oil is fed from the main oil gallery 43 to the groove 22A of the journal bearing 23 through the oil passage 46, and is delivered from the inlet 47A to the outlet 47B through the interior of the oil passage 47 to lubricate the region at which the big end 53A of the connecting rod 53 and the crank pin 52 are configured to slidably contact each other. A part of the oil discharged from the outlet 47B of the oil passage 47 is injected to a rear surface of the piston 54 through the oil passage 48 formed on the big end 53A of the connecting rod 53.

Figure 3:
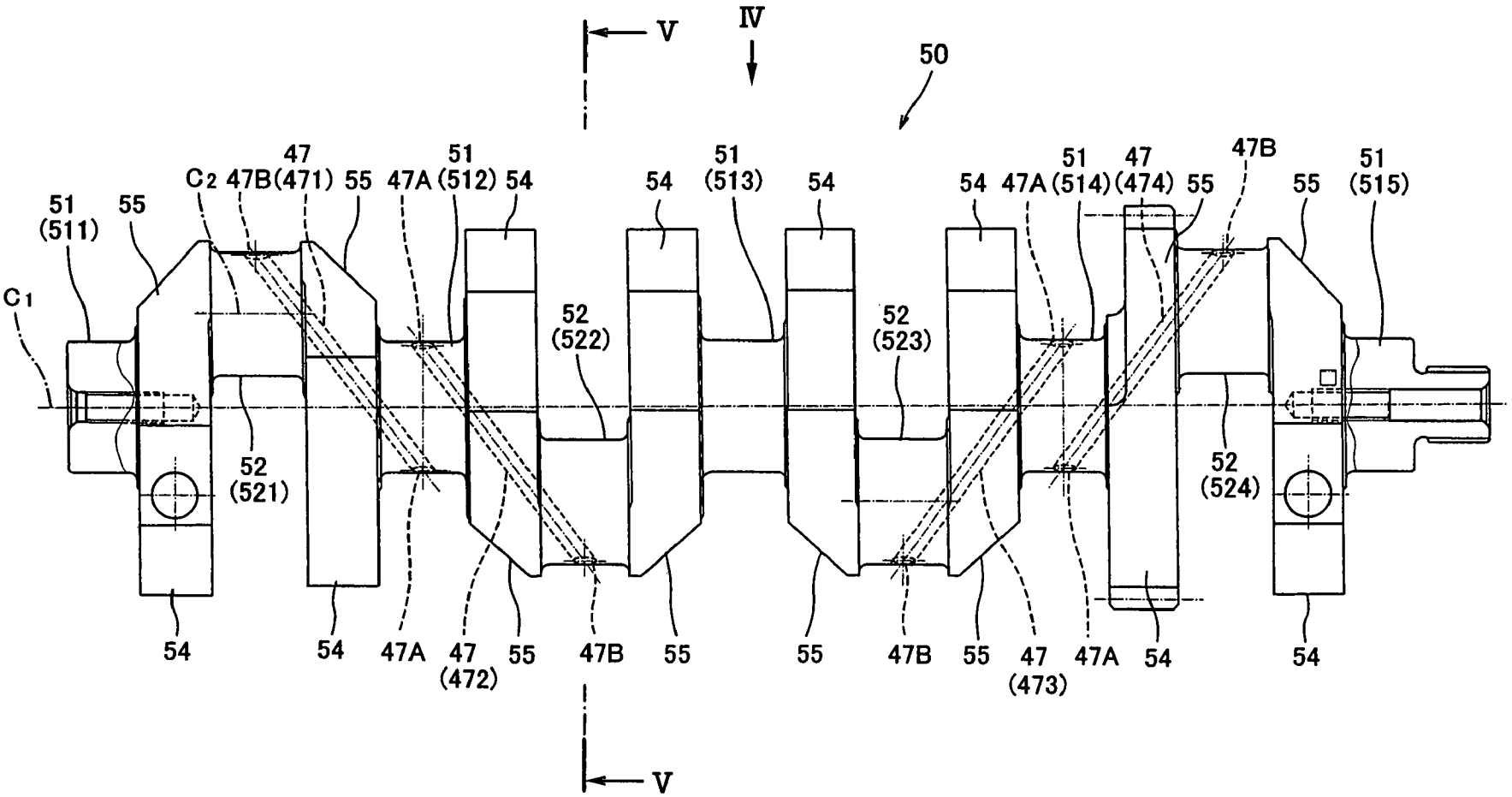
FIG. 3 is a front view showing a construction of an entire crankshaft of FIG. 2.
Figure 4:
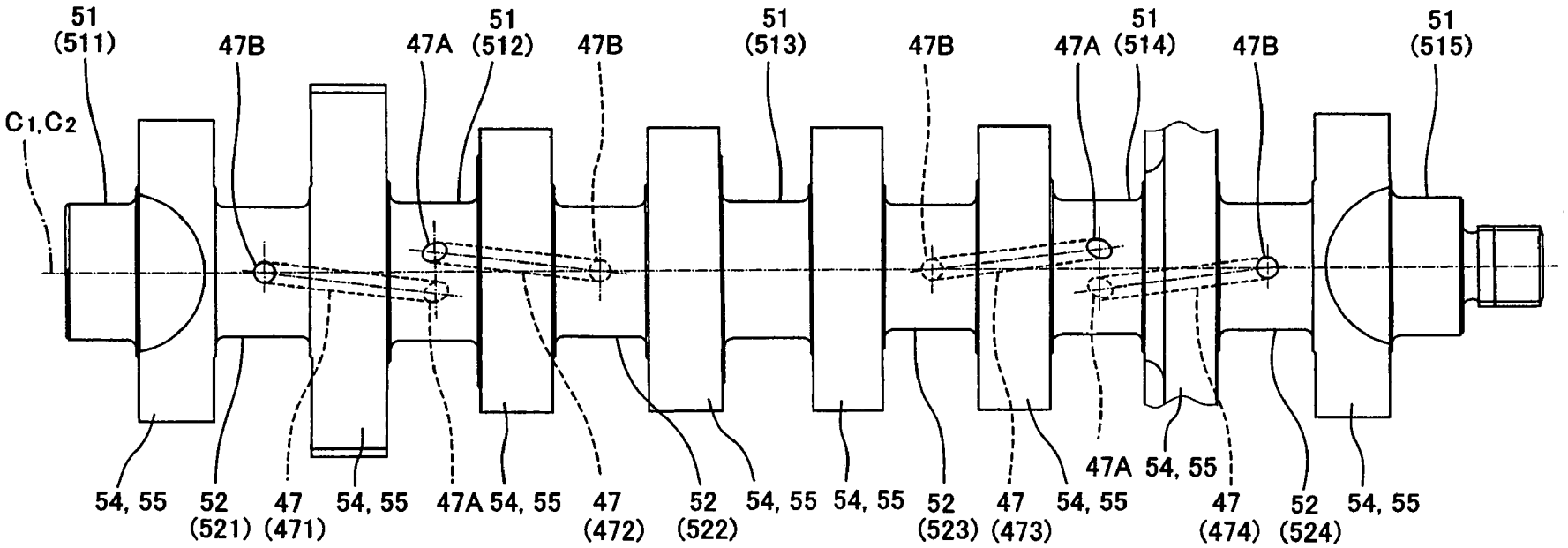
FIG. 4 is a plan view of the crankshaft taken along in the direction of arrow IV of FIG. 3.
Figure 5:
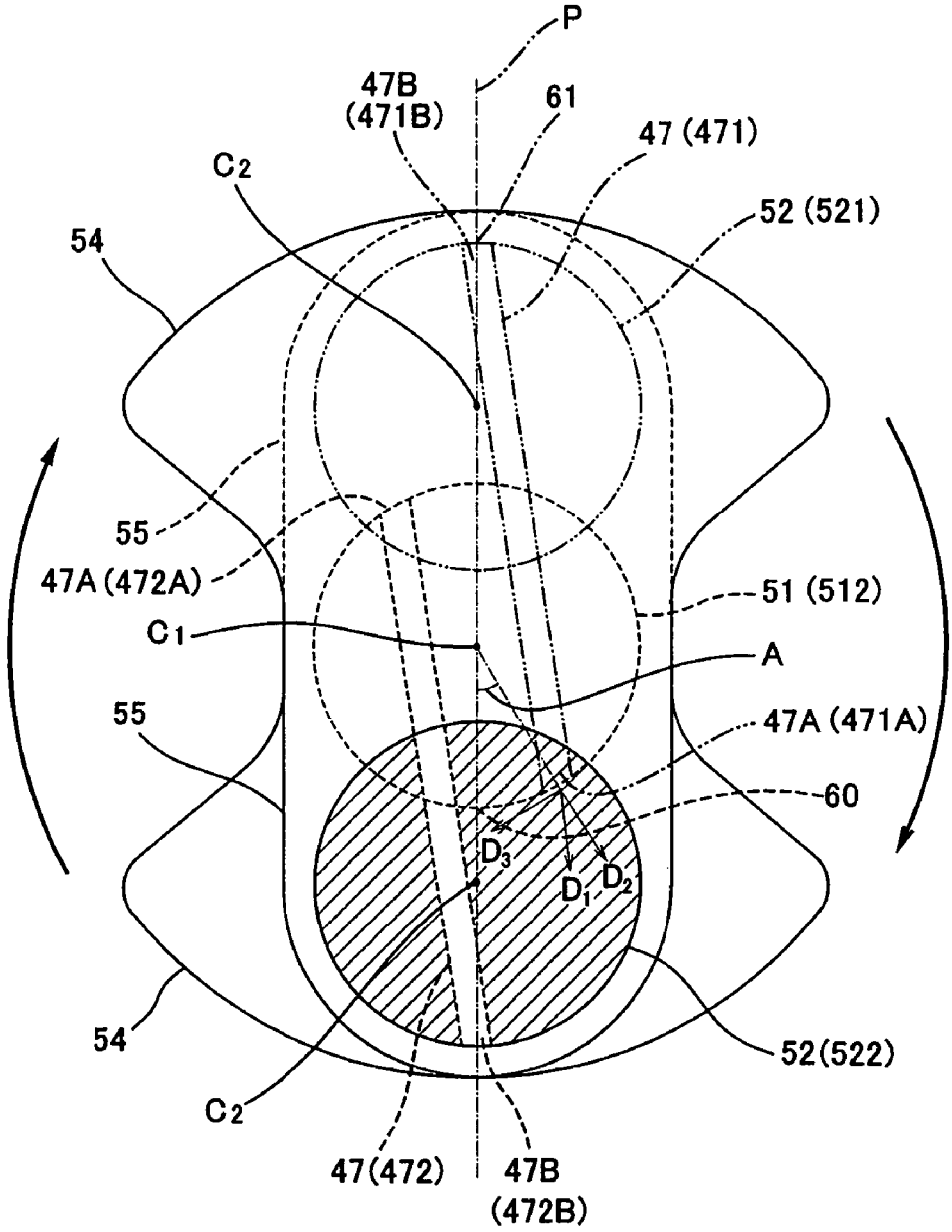
FIG. 5 is a cross-sectional view of the crankshaft taken in the direction of arrows V-V of FIG. 3.

FIG. 3 is a front view showing a construction of the entire of the crankshaft 50 of FIG. 2. FIG. 4 is a plan view of the crankshaft 50 taken in the direction of an arrow IV of FIG. 3. FIG. 5 is a cross-sectional view of the crankshaft 50, taken in the direction of arrows V-V of FIG. 3. In FIG. 5, the crank pin 522 located on the nearest side is indicated by a solid line, and the crank journal 512 located on the far side of the crank pin 522 is indicated by a broken line. In addition, the crank pin 521 located on the far side of the crank journal 512 is indicated by a two-dotted line.

As shown in FIGS. 3 and 4, the crankshaft 50 equipped in the four-cylinder engine E has crank journals 51 (including respective crank journals 511 to 515) arranged in the direction from one side toward an opposite side, from the left to the right in FIG. 3. The crank pins 52 (including respective crank pins 521 to 524) respectively corresponding to the first to fourth cylinders are each positioned between adjacent crank journals 51. Each crank pin 52 is connected to the adjacent crank journals 51 by crank webs 55 integral with crank weights 54. As shown in FIG. 5, the crankshaft 50 of this embodiment rotates clockwise around a center axis $C_1$ thereof as seen from the direction of arrows V-V of FIG. 3.

The crankshaft 50 is provided with four oil passages 47, respectively indicated at 471 to 474. Oil passage 471 is formed between the crank pin 521 corresponding to the first cylinder 211 (see FIG. 2) and the crank journal 512 located between the crank pins 521 and 522 and the oil passage 472 is formed between the crank pin 522 corresponding to the second cylinder 212 (see FIG. 2) and the crank journal 512. In addition, the oil passage 473 is formed between the crank pin 523 corresponding to the third cylinder and the crank journal 514 located between the crank pins 523 and 524 and the oil passage 474 is formed between the crank pin 524 corresponding to the fourth cylinder and the crank journal 514. The oil passages 471 and 472 are symmetric in shape to the oil passages 473 and 474 with respect to a line extending through a center of the crank journal 513 located at a center of the crankshaft 50 in a direction perpendicular to the center axis (center axes of the crank journals 51) of the crankshaft 50. Below, the oil passages 471 and 472 will be described in detail.

As shown in FIGS. 3 and 4, the oil passage 471 is of a straight line shape, and extends obliquely from the crank journal 512 toward the crank pin 521. The inlet 471A of the oil passage 471 is formed in a specified position at a peripheral region of the crank journal 512, and the outlet 471B is formed in a specified position at the peripheral region of the crank pin 521.

As shown in FIG. 5, assume that a plane P includes a center axis $C_1$ of the crank journal 512 and a center axis $C_2$ of the crank pin 521. The plane P crosses a peripheral surface of the crank journal 512 at two cross portions. The cross portion located on the opposite side of the crank pin 521 with respect to the center axis $C_1$ of the crank journal 512 is referred to as a journal side cross portion 60. The inlet 471A of the oil passage 471 is formed at a peripheral region of the crank journal 512 to be positioned spaced counterclockwise (in the opposite direction to the rotational direction of the crank journal 512) apart from the journal side cross portion 60. As shown in FIG. 5, a line segment connecting the center axis $C_1$ of the crank journal 512 to the journal side cross portion 60 and a line segment connecting the center axis $C_1$ to an opening center of the inlet 471A form an acute angle "A."

As shown in FIG. 5, the plane P crosses a peripheral surface of the crank pin 521 at two cross portions. The cross portion located on the opposite side of the crank journal 512 with respect to the center axis $C_2$ of the crank pin 521 is referred to as a pin side cross portion 61. The outlet 471B of the oil passage 471 is formed at the pin side cross portion 61 in the peripheral region of the crank pin 521. To be more specific, as shown in FIG. 5, the outlet 471B is formed to include the pin side cross portion 61 within an opening of the outlet 471B.

Since the oil passage 471 is formed in the straight line shape so as to connect the inlet 471A to the outlet 471B, it extends through a position apart from the center axis $C_1$, as seen from the direction of the center axis $C_1$ of the crank journal 512. As shown in FIG. 5, an opening direction $D_1$ of the inlet 471A is slightly inclined in a rotational (advancement) direction $D_3$ of the inlet 471A of the crank journal 512 rotating, with respect to a radial direction $D_2$ of the crank journal 512 that is from the center axis $C_1$ of the crank journal 512 toward the inlet 471A.

As shown in FIGS. 3 and 4, the oil passage 472 is of a straight line shape and extends from the crank journal 512 toward the crank pin 522. The oil passage 472 extends substantially in parallel with the oil passage 471. The oil passage 472 has an inlet 472A in a specified position at a peripheral region of the crank journal 512 and an outlet 472B in a specified position at a peripheral region of the crank pin 522. A structure of the oil passage 472 including the inlet 472A and the outlet 472B is identical to that of the oil passage 471, and will not be further described.

Figure 6:
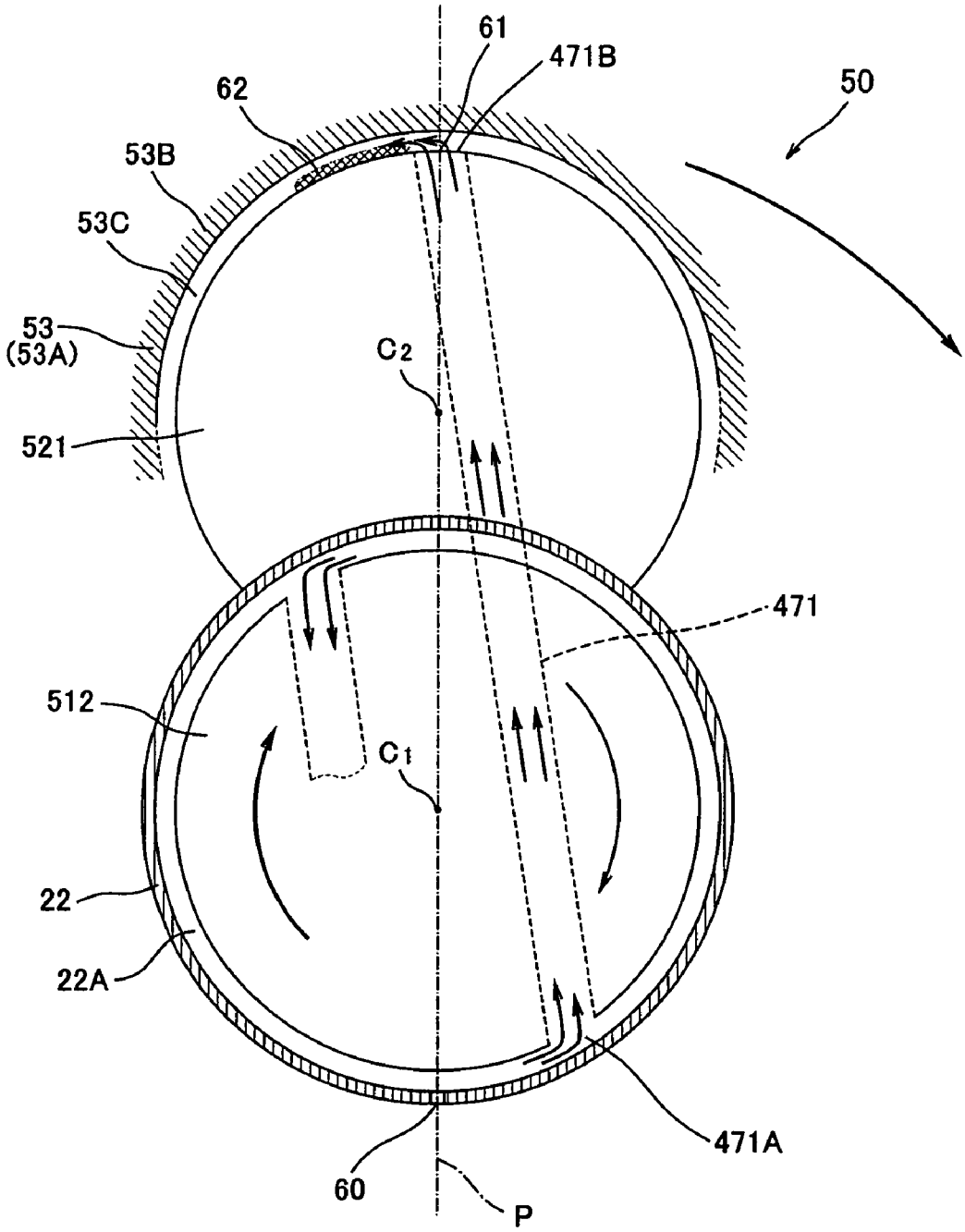
FIG. 6 is a view schematically showing a flow of oil during rotation of the crankshaft according to an embodiment of the present invention.

FIG. 6 is a view schematically showing a flow of the oil that occurs during rotation of the crankshaft 50 constructed as described above. The manner in which the oil flows in the oil passage 471 will be in large part described. As shown in FIG. 6, when the crankshaft 50 rotates clockwise, the oil existing in a gap between the groove 22A of the metal structure 22 forming the journal bearing 23 (see FIG. 2) and the outer peripheral surface of the crank journal 512 flows into the oil passage 471 through the inlet 471A.

Figure 7:
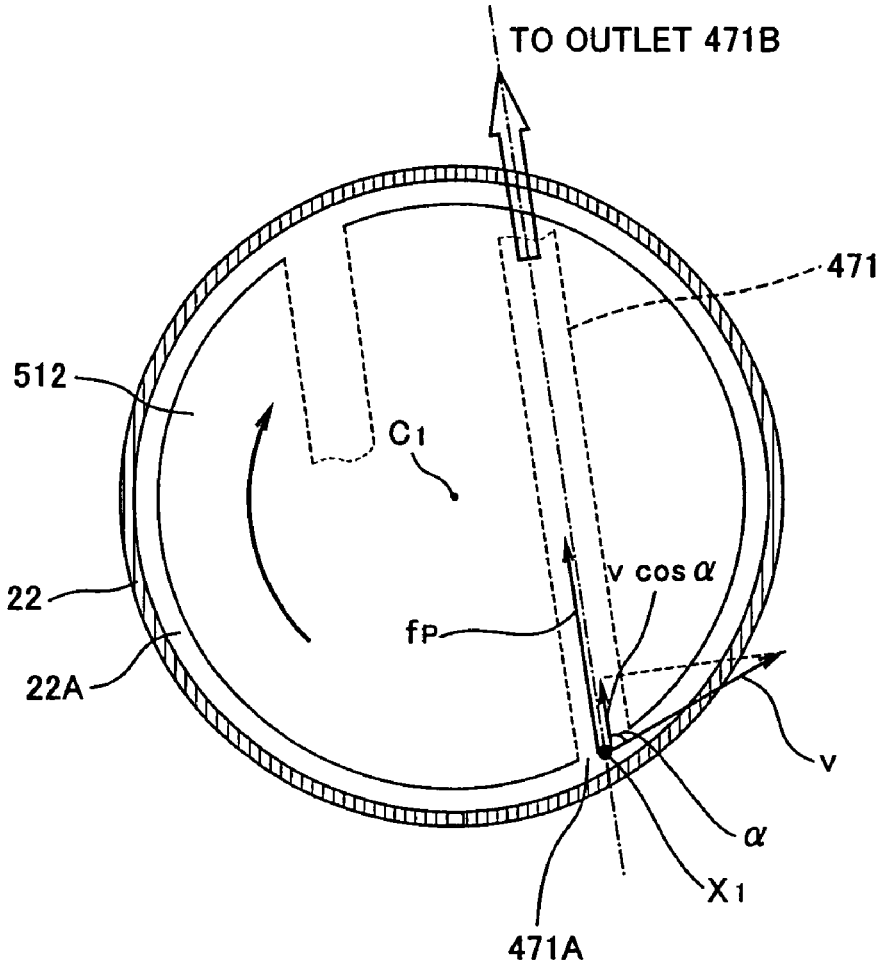
FIG. 7 is a view schematically showing a force in a flow direction applied to the oil existing in an interior of the oil passage of the crankshaft of FIG. 6 and in the vicinity of an inlet of the oil passage.

Since the opening direction $D_1$ of the inlet 471A is inclined in the rotational (advancement) direction $D_3$ of the inlet 471A of the crank journal 512 rotating, with respect to the radial direction $D_2$ of the crank journal 512 that is from the center axis $C_1$ of the crank journal 512 toward the inlet 471A, as already described with reference to FIG. 5, the oil easily flows into the oil passage 471 through the inlet 471A. As shown in FIG. 7, oil $X_1$ (represented by a black circle in FIG. 7) existing in the vicinity of the inlet 471A and having a unit volume with a density ρ is subjected to a force $f_p$ oriented in all directions because of its own pressure. According to the rotation of the crank journal 512, the oil $X_1$ moves close to the inlet 471A at a relative velocity v in the circumferential direction of the crank journal 512. When an angle formed between the opening direction $D_1$ of the inlet 471A (i.e., direction in which the oil passage 471 extends) and the direction of the relative velocity v is α, a momentum $p_1$ of the oil $X_1$ in the opening direction $D_1$ of the inlet 471A is represented by a formula (1):

$$p_1 = f_p \cdot \Delta t + \rho \cdot v \cdot \cos \alpha \quad (1)$$

If the inlet 471A is not inclined but opens in the radial direction $D_2$ of the crank journal 512, then a momentum $P_2$ of the oil $X_1$ having the unit volume in the opening direction $D_1$ of the inlet 471A is represented only by a first term of a right side in the formula (1). The relationship between $P_1$ and $P_2$ is $P_1 > P_2$. From this, the inlet 471A of the oil passage 471 of the embodiment is configured to enable the oil to flow easily thereinto.

Figure 8:
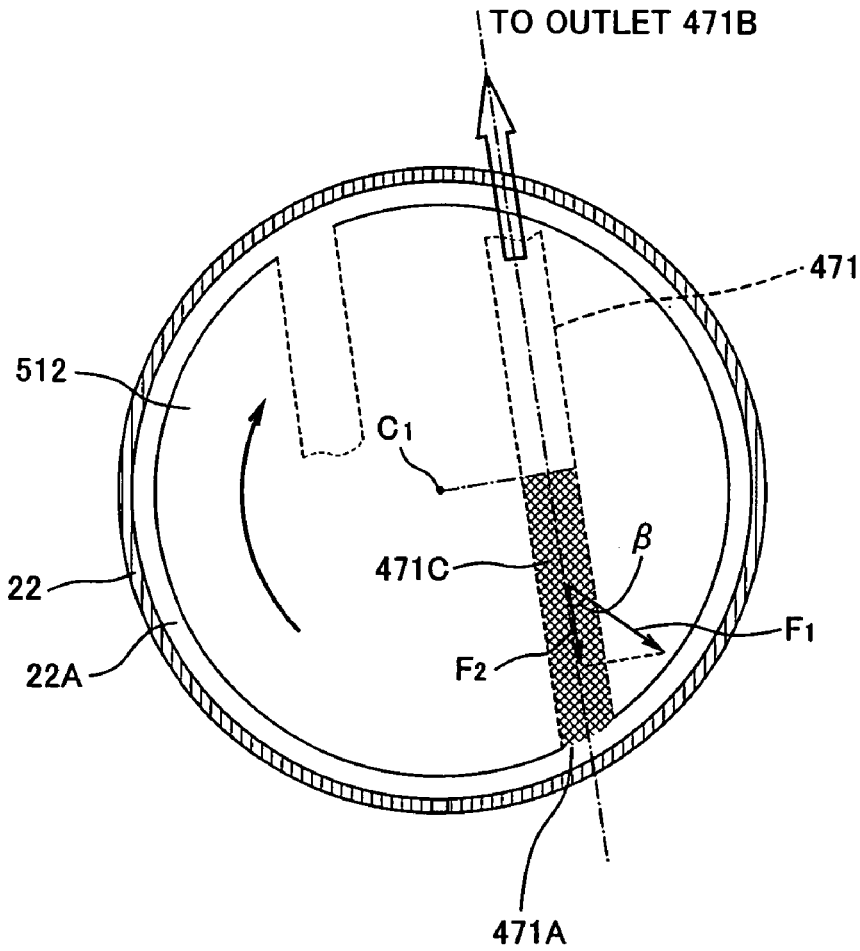
FIG. 8 is a view schematically showing a centrifugal force applied to the oil in the interior of the oil passage of the crankshaft of FIG. 6.

The oil that has inflowed from the inlet 471A flows toward the outlet 471B through the oil passage 471. Since the oil passage 471 is spaced apart from the center axis $C_1$ of the crank journal 512, the oil easily flows toward the outlet 471B. As shown in FIG. 8, oil existing in a region 471C (region hatched in FIG. 8) of the oil passage 471 that extends from the inlet 471A to a point closest to the center axis $C_1$ of the crank journal 512 is subjected to a centrifugal force $F_1$ oriented radially outward of the crank journal 512. When an oil flow direction component of the centrifugal force $F_1$ is $F_2$, $$F_2 = F_1 \cdot \cos \beta \quad (2)$$

β indicates an acute angle formed between the direction of the centrifugal force $F_1$ and the oil flow direction (direction in which the oil passage 471 extends). As should be appreciated, only a force component $F_2$ ($<F_1$) of the centrifugal force $F_1$ oriented radially outward is applied to the oil in the region 471C, a flow resistance due to the centrifugal force can be reduced so that the oil easily flows toward the outlet 471B. The oil existing in a region located closer to the outlet 471B than the region 471C is more likely subjected to a centrifugal force oriented toward the outlet 471B.

As shown in FIG. 6, the oil flows through the oil passage 471 and is discharged from the outlet 471B that opens at the pin side cross portion 61 in the peripheral region of the crank pin 521. Then, the oil flows into the groove 53C formed on the inner peripheral surface of the crank pin bearing 53B mounted on the large end 53A of the connecting rod 53. The oil outflowing from the outlet 471B is more likely to flow in the opposite direction to the rotational direction of the crank pin 521, according to the rotation of the crank pin 521. For this reason, sufficient oil is fed to a region 62 located in the vicinity of the outlet 471B to be spaced apart in the opposite direction to the rotational direction of the crank pin 521.

The crankshaft 50 is suitably constructed to enable the oil to be sufficiently fed to the region 62. The engine E is configured to generate a drive force by explosion that correctly takes place in a combustion chamber (not shown) in each cylinder. For example, when the explosion correctly takes place in the interior of the combustion chamber (not shown) of the first cylinder 211, the piston 54 moves downward according to expansion of a fuel gas. This causes the connecting rod 53 to be pushed down such that the big end 53A is brought into contact with the crank pin 521 with a large contact load. The contact load having a greatest value is a greatest explosion load.

In the peripheral region of the crank pin 521, the region 62 (see FIG. 6) located in the vicinity of the pin side cross portion 61 to be spaced apart in the opposite direction to the rotational direction of the crank pin 521, is most likely to be subjected to the greatest explosion load. In the crankshaft 50 of the embodiment, the oil is sufficiently fed to the region 62 that tends to be subjected to the greatest explosion load. As a result, suitable lubrication is accomplished.

As described above, in accordance with the crankshaft 50, the oil easily flows in the oil passage 471. Therefore, the oil is fed sufficiently to the crank pin 521 without increasing the size of the oil pump 27. In addition, the oil serves to suitably lubricate the region 62 in the peripheral region of the crank pin 521 that is most likely to be subjected to the greatest explosion load. Such advantages are achieved in the oil passages 472 to 474 and the crank pins 522 to 524 as well as in the oil passage 471 and the crank pin 521.

Furthermore, since the oil passages 471 and 472 extend substantially in parallel with each other, bores are easily drilled into the crankshaft 50. Since the oil passage 471 and 472 extend substantially in parallel with each other, it is not necessary to change the orientation of a drill machine or to change the orientation of the crankshaft 50 and re-fix the crankshaft 50, after one of the passages is manufactured by a drilling work. The same applies to the oil passages 473 and 474.

The depicted embodiment of the inline four-cylinder engine E mounted in the road sport type is merely exemplary. For example, the present invention may be applied to crankshafts of engines mounted in motorcycles of other types or four-wheeled vehicles. Further, the present invention may be applied to engines other than the inline four-cylinder engine.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A crankshaft equipped in an engine, comprising:

an oil passage through which oil is drawn from a crank journal of the crankshaft to a crank pin of the crankshaft;

wherein the oil passage has an inlet formed at a peripheral region of the crank journal, and when a plane including a center axis of the crank journal and a center axis of the crank pin crosses a peripheral surface of the crank journal at two cross points in a cross-section perpendicular to the center axis of the crank journal, the inlet is located to be spaced apart in an opposite direction to a rotational direction of the crank journal from a journal side cross point which is one of the two cross points of the crank journal, the journal side cross portion being located on an opposite side of the crank pin with respect to the center axis of the crank journal;

wherein the oil passage is configured to extend to be spaced apart from the center axis of the crank journal as seen from a direction of the center axis of the crank journal, and wherein the inlet of the oil passage is configured to have an opening direction inclined in the rotational direction of the crank journal at the inlet, with respect to a radial direction of the crank journal from center axis of the crank journal toward the inlet; and wherein the oil passage is configured to extend in a straight line shape from the inlet to an outlet formed at a peripheral region of the crank pin.

2. The crankshaft according to claim 1, wherein when the plane crosses a peripheral surface of the crank pin at two cross points in a cross-section perpendicular to the center axis of the crank pin, the outlet is formed to include within an opening thereof a pin side cross point which is one of the two cross points of the crank pin, the pin side cross portion being located on an opposite side of the crank journal with respect to the center axis of the crank pin.

3. The crankshaft according to claim 1, wherein the oil passage is a first of at least two oil passages configured to extend substantially in parallel with each other, and wherein the crank pin includes two crank pins that are located adjacent and on both sides of the crank journal, one of the oil passages being located between the crank journal and one of the two crank pins, the other one of the oil passages being located between the crank journal and the other crank pin.

* * * * *